US008009996B2

(12) United States Patent
Ishikawa

(10) Patent No.: US 8,009,996 B2
(45) Date of Patent: Aug. 30, 2011

(54) IMAGE FORMING APPARATUS INCLUDING UNIT FOR DETERMINING TYPE OF DEVELOPER CARTRIDGE

(75) Inventor: Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 770 days.

(21) Appl. No.: 12/039,223

(22) Filed: Feb. 28, 2008

(65) Prior Publication Data

US 2008/0205931 A1 Aug. 28, 2008

(30) Foreign Application Priority Data

Feb. 28, 2007 (JP) ..... 2007-050720

(51) Int. Cl.
*G03G 15/00* (2006.01)
*G03G 15/08* (2006.01)

(52) U.S. Cl. ..... 399/12; 399/13; 399/119

(58) Field of Classification Search ..... 399/12, 399/13, 119
See application file for complete search history.

(56) References Cited

U.S. PATENT DOCUMENTS

| | | | | |
|---|---|---|---|---|
| 6,298,202 | B1 * | 10/2001 | Fushiya et al. | 399/12 |
| 7,512,347 | B2 * | 3/2009 | Suzuki et al. | 399/12 |
| 7,574,148 | B2 * | 8/2009 | Igarashi et al. | 399/12 |
| 7,756,426 | B2 * | 7/2010 | Kamimura | 399/12 |
| 2006/0193645 | A1 | 8/2006 | Kishi | |
| 2006/0193646 | A1 | 8/2006 | Suzuki et al. | |
| 2008/0205911 | A1 | 8/2008 | Ishikawa et al. | |
| 2008/0205928 | A1 | 8/2008 | Ishikawa | |
| 2008/0223173 | A1 | 9/2008 | Ishikawa | |

FOREIGN PATENT DOCUMENTS

| | | | |
|---|---|---|---|
| JP | 06-258910 | | 9/1994 |
| JP | 9-258634 | A | 10/1997 |
| JP | 2003-316227 | A | 11/2003 |
| JP | 2006-243071 | | 9/2006 |
| JP | 2006-267994 | | 10/2006 |
| JP | 2008-216392 | A | 9/2008 |
| JP | 2008-216393 | A | 9/2008 |
| JP | 2008-216394 | A | 9/2008 |

OTHER PUBLICATIONS

Extended EP Search Report dtd May 3, 2010, EP Appln. 08003593.4.

* cited by examiner

*Primary Examiner* — William J Royer
(74) *Attorney, Agent, or Firm* — Banner & Witcoff, Ltd.

(57) ABSTRACT

An image forming apparatus includes a main unit; and a developer cartridge detachably attached to the main unit. The developer cartridge includes a rotational body having a rotational axis and rotatable in a rotation direction; and an extended portion formed on the rotational body to extend along the rotational axis, the extended portion rotatable around the rotational axis. The main unit includes a driving unit configured to rotate the rotational body in the rotation direction; a detecting unit configured to detect a movement of the extended portion and an extending amount of the extended portion; and a determining unit configured to: determine whether the developer cartridge is a new product according to a presence of a movement of the extended portion detected by the detecting unit; and determine type of the developer cartridge based on the extending amount of the extended portion detected by the detecting unit.

15 Claims, 8 Drawing Sheets

IMAGE FORMING APPARATUS INCLUDING UNIT FOR DETERMINING TYPE OF DEVELOPER CARTRIDGE

CROSS-REFERENCE TO RELATED APPLICATIONS

This application is based upon and claims the benefit of priority from Japanese Patent Application No. 2007-050720, filed on Feb. 28, 2007, the entire contents of which are incorporated herein by reference.

TECHNICAL FIELD

One aspect of the present invention relates to an image forming apparatus which can perform new-product detection and type detection of a developer cartridge.

BACKGROUND

Generally, in image forming apparatuses such as laser printers, developer cartridges containing toner are detachably attached to their apparatus bodies. For example, JP-A-2006-267994 discloses an image forming apparatus capable of determining whether an attached developer cartridge is a new product (new-product detection) and also determining a type of the developer cartridge (type detection) (see JP-A-2006-267994).

Specifically, the image forming apparatus disclosed in JP-A-2006-267994 includes, in a main unit, a swingable arm-shaped actuator, a spring that urges the actuator to a neutral position, a sensor that detects a swing of the actuator, and a controller that carries out new-product detection and type detection based on signals from the sensor. In addition, the image forming apparatus includes, in the developer cartridge, one or two contact projections extending radially outside from a predetermined shaft portion and a sensing gear that rotates around the shaft portion integrally with the contact projection.

In this image forming apparatus, when the developer cartridge is attached to the main unit, the contact projection presses one end of the actuator to swing the actuator, and this swing is detected by the sensor. A signal detected by this sensor is sent to the controller as a first detection signal. The controller determines, if having received this first detection signal, that the developer cartridge is a new product.

Moreover, in this image forming apparatus, when, for example, a front cover is closed after the developer cartridge is attached, a warm-up operation (idle rotation operation) is executed by the controller. Here, the idle rotation operation means an operation to rotate an agitator in the developer cartridge in order to agitate the toner contained in the developer cartridge.

In such an idle rotation operation, a transmission force from a drive source provided in the main unit is transmitted to the agitator and the sensing gear on the developer cartridge side via a plurality of gears. Thereby, agitation of the toner by the agitator is started, and the contact projection is rotated to further press the end of the actuator and separate from the actuator at a predetermined position. Thereafter, the actuator is to return to the neutral position due to an urging force of the spring. At this time, when two contact projections exist, the second contact projection again presses the end of the actuator to swing the actuator, and this swing is detected by the sensor. A signal detected by this sensor is sent to the controller as a second detection signal.

When the controller receives the second detection signal, the controller determines that the developer cartridge has a type A (for example, a type where the maximum sheets to be printed are 6000). Meanwhile, when the controller does not receive the second detection signal, the controller determines that the developer cartridge has a type B (for example, a type where the maximum sheets to be printed are 3000) different from the type A.

However, in the above image forming apparatus, the type have been detected based on the number of times the contact projection contacts with the actuator. Therefore, in order to make the two contact projections contact with the actuator, it is necessary to increase the amount of rotation of the sensing gear. For this reason, the moving range of the contact projections is increased. In addition, for the necessity of providing other elements outside the moving range thus increased, the size of the developer cartridge cannot be reduced.

SUMMARY

One aspect of the invention has an object of the present invention to provide an image forming apparatus which can satisfactorily carry out new-product detection and type detection and can reduce the size of a developer cartridge.

According to an aspect of the invention, there is provided an image forming apparatus comprising: a main unit; and a developer cartridge detachably attached to the main unit, wherein the developer cartridge comprises: a rotational body having a rotational axis and rotatable in a rotation direction; and an extended portion formed on the rotational body to extend along the rotational axis, the extended portion rotatable around the rotational axis, and wherein the main unit comprises: a driving unit configured to rotate the rotational body in the rotation direction; a detecting unit configured to detect a movement of the extended portion and an extending amount of the extended portion; and a determining unit configured to: determine whether the developer cartridge is a new product according to a presence of a movement of the extended portion detected by the detecting unit; and determine type of the developer cartridge based on the extending amount of the extended portion detected by the detecting unit.

BRIEF DESCRIPTION OF THE DRAWINGS

FIGS. 6A and 6B are perspective views showing a new-product/type detecting device, wherein FIG. 6A is a perspective view showing respective elements of the new-product/type detecting device and FIG. 6B is a perspective view showing a relationship between a first swing member, a second swing member, and an extended portion;

FIGS. 7A to 7D are views for explaining operations of a rotational body and the like when a developer cartridge of a type, where the maximum sheets to be printed are 3000, is attached to the main casing, wherein FIG. 7A is an explanatory view showing a state before the attachment, FIG. 7B is an explanatory view showing a state immediately after the attachment, FIG. 7C is an explanatory view showing an operation during an idle rotation operation, and FIG. 7D is an explanatory view showing a state where the rotational body has been irreversibly rotated; and FIGS. 8A to 8D are views for explaining operations of a rotational body when a developer cartridge of a type, where the maximum sheets to be printed are 6000, is attached to the main casing, wherein FIG. 8A is an explanatory view showing a state before the attachment, FIG. 8B is an explanatory view showing a state immediately after the attachment, FIG. 8C is an explanatory view showing an operation during an idle rotation operation, and FIG. 8D is an explanatory view showing a state where the rotational body has been irreversibly rotated.

DESCRIPTION

Figure 1:
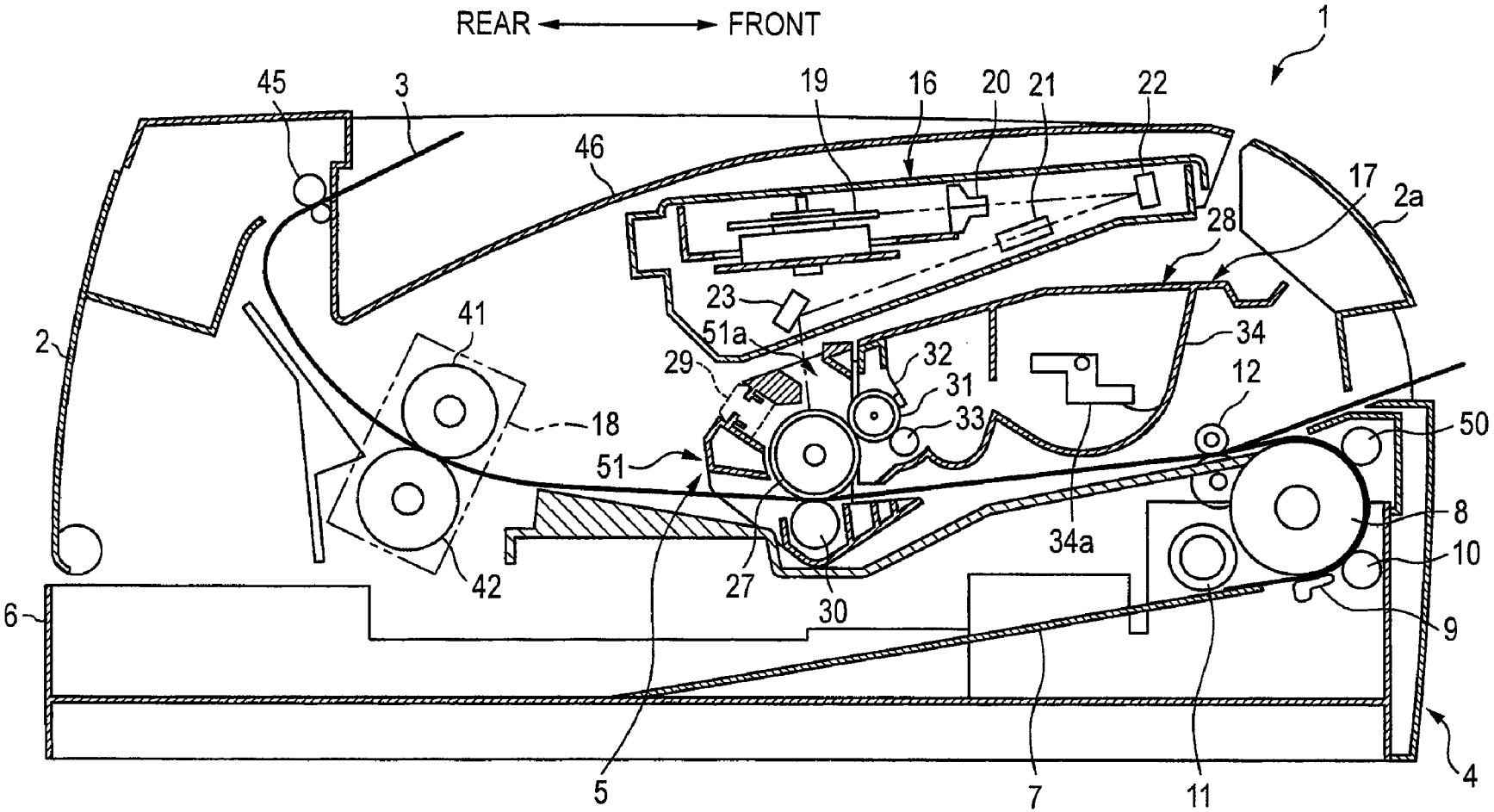
FIG. 1 is a side cross-sectional view showing a laser printer according to an embodiment of the present invention.

Next, an embodiment of the present invention will be described in detail with appropriate reference to the drawings. Of the drawings to be referred to, FIG. 1 is a side cross-sectional view showing a laser printer according to an embodiment of the present invention. Also, in the following description, the entire configuration of a laser printer will be briefly described at first, and then the details of the configuration will be described. In the following description, descriptions will be given in directions with reference to a user when using a laser printer 1. That is, in FIG. 1, the right side is referred to as "a front side," the left side is referred to as "a rear side," a back side in the direction vertical to the sheet surface is referred to as "a right side," and a near side in the direction vertical to the sheet surface is referred to as "a left side." Also, in terms of the up-and-down direction, since the illustrated direction is coincident with a direction when a user uses the laser printer, this is referred to as "an up-and-down direction" as it is.

<Entire Configuration of Laser Printer>

As shown in FIG. 1, the laser printer 1 provided as an image forming apparatus mainly includes a feeder unit 4 for feeding a sheet 3 into a main casing 2 provided as a main unit, and an image forming unit 5 for forming an image on the fed sheet 3.

<Configuration of Feeder Unit>

The feeder unit 4 includes a sheet feeding tray 6 that is detachably attached to a bottom portion in the main casing 2 and a sheet pressing plate 7 provided in the sheet feeding tray 6. In addition, the feeder unit 4 includes a send-out roller 11 provided above a one side end portion of the sheet feeding tray 6 and a feed roller 8, a feed pad 9, a pinch roller 10, and a paper dust removing roller 50 provided at a downstream side in the conveying direction of the sheet 3 with respect to the send-out roller 11. Further, the feeder unit 4 includes a registration roller 12 provided at a downstream side with respect to the paper dust removing roller 50.

In the feeder unit 4 thus configured, the sheets 3 in the sheet feeding tray 6 are brought close to the send-out roller 11 side by the sheet pressing plate 7, and sent out by the send-out roller 11 between the feed roller 8 and the feed pad 9. In addition, the sheets 3 are sent out one by one by the feed roller 8 and the feed pad 9 to pass through the various rollers 10, 50, and 12, and then conveyed to the image forming unit 5

<Configuration of Image Forming Unit>

The image forming unit 5 mainly includes a scanner unit 16, a process cartridge 17, and a fixing unit 18.

<Configuration of Scanner Unit>

The scanner unit 16 is provided at an upper portion in the main casing 2 and mainly includes a laser light emitting unit (not shown), a polygon mirror 19 that is driven to rotate, lenses 20 and 21, and reflecting mirrors 22 and 23. A laser beam emitted from the laser light emitting unit and based on image data is, as shown by dot-dash lines, passed through or reflected on the polygon mirror 19, the lens 20, the reflecting mirror 22, the lens 21, and the reflecting mirror 23 in this order, and is irradiated onto the surface of a photosensitive drum 27 of the process cartridge 17 by high-speed scanning.

<Configuration of Process Cartridge>

The process cartridge 17 is detachably attached to the main casing 2 by appropriately opening a front cover 2*a* provided at the front side of the main casing 2. The process cartridge 17 mainly includes a developer cartridge 28 and a drum unit 51.

The developer cartridge 28 is detachably attached to the main casing 2 via the drum unit 51, more specifically, detachably attached to the drum unit 51 fixed to the main casing 2. Also, the attachment of the developer cartridge 28 to the main casing 2 may be carried out with the developer cartridge 28 alone, or may be carried out with the process cartridge 17 for which the drum unit 51 is attached to the developer cartridge 28.

The developer cartridge 28 mainly includes a developing roller 31, a layer thickness restricting blade 32, a supply roller 33, and a toner hopper 34. A toner in the toner hopper 34 is supplied to the developing roller 31 by the supply roller 33 after being agitated by an agitator 34*a*, and is, at this time, frictionally charged positively between the supply roller 33 and the developing roller 31. The toner supplied onto the developing roller 31 enters between the layer thickness restricting blade 32 and the developing roller 31 with a rotation of the developing roller 31 and is supported on the developing roller 31 as a thin layer with a fixed thickness. Also, details of the developer cartridge 28 will be described later.

The drum unit 51 mainly includes the photosensitive drum 27, a scorotron charger 29, and a transfer roller 30.

The photosensitive drum 27 is rotatably supported on a case of the drum unit 51. For the photosensitive drum 27, a drum body is grounded, and its surface part is formed of a positively charged photosensitive layer. Above the photosensitive drum 27, disposed is an exposure window 51 a formed in a hole shape on the case of the drum unit 51.

The scorotron charger 29 is arranged obliquely above the photosensitive drum 27 (more specifically, at the rear side and the upper side of the photosensitive drum 27) at a distance of a predetermined interval so as not to contact with the photosensitive drum 27. The scorotron charger 29 is a scorotron charger for positive charging that produces a corona discharge from a charging wire made of tungsten or the like, and is configured so as to uniformly charge the surface of the photosensitive drum 27 with a positive polarity.

The transfer roller 30 is arranged, below the photosensitive drum 27, so as to be opposed to and contact with the photosensitive drum 27, and is rotatably supported on the case of the drum unit 51. The transfer roller 30 is formed by covering a metallic roller shaft with a conductive rubber material. This transfer roller 30 is applied with a transfer bias by constant current control at the time of transfer.

The surface of the photosensitive drum 27 is uniformly positively charged by the scorotron charger 29, and is then exposed with light by high-speed scanning of a laser beam from the scanner unit 16. Thereby, an exposed part is lowered in potential to form an electrostatic latent image based on image data. Here, the "electrostatic latent image" denotes, of the surface of the photosensitive drum 27 uniformly positively charged, the exposed part lowered in potential by being exposed with a laser beam. Subsequently, by a rotation of the developing roller 31, the toner supported on the developing roller 31 is supplied to the electrostatic latent image formed on the surface of the photosensitive drum 27 when the developing roller 31 is opposed to and contacts with the photosensitive drum 27. Then, the toner is formed into a visible image by being selectively supported on the surface of the photosensitive drum 27, whereby a toner image is formed by reversal development.

Thereafter, the photosensitive drum 27 and the transfer roller 30 are driven to rotate so as to convey the sheet 3 while sandwiching the same therebetween, and as a result of the sheet 3 being conveyed between the photosensitive drum 27 and the transfer roller 30, the toner image supported on the surface of the photosensitive drum 27 is transferred onto the sheet 3.

<Configuration of Fixing Unit>

The fixing unit 18 is disposed at a downstream side of the process cartridge 17, and includes a heating roller 41 and a pressing roller 42 that is arranged in a manner opposed to the heating roller 41 and presses the heating roller 41. In the fixing unit 18 thus configured, the toner transferred onto the sheet 3 is thermally fixed during the time the sheet 3 passes between the heating roller 41 and the pressing roller 42. Moreover, the sheet 3 thermally fixed by the fixing unit 18 is conveyed to a discharge roller 45 disposed at a downstream side of the fixing unit 18, and is sent out from the discharge roller 45 onto a sheet discharging tray 46.

<Detailed Structures of Developer Cartridge and Inside of Main Casing>

Next, description will be given of detailed structures of the developer cartridge 28 and the inside of the main casing 2 to be characteristic parts of the present invention with reference to FIGS. 2 to 6B.

<Detailed Structure of Developer Cartridge>

Figure 2:
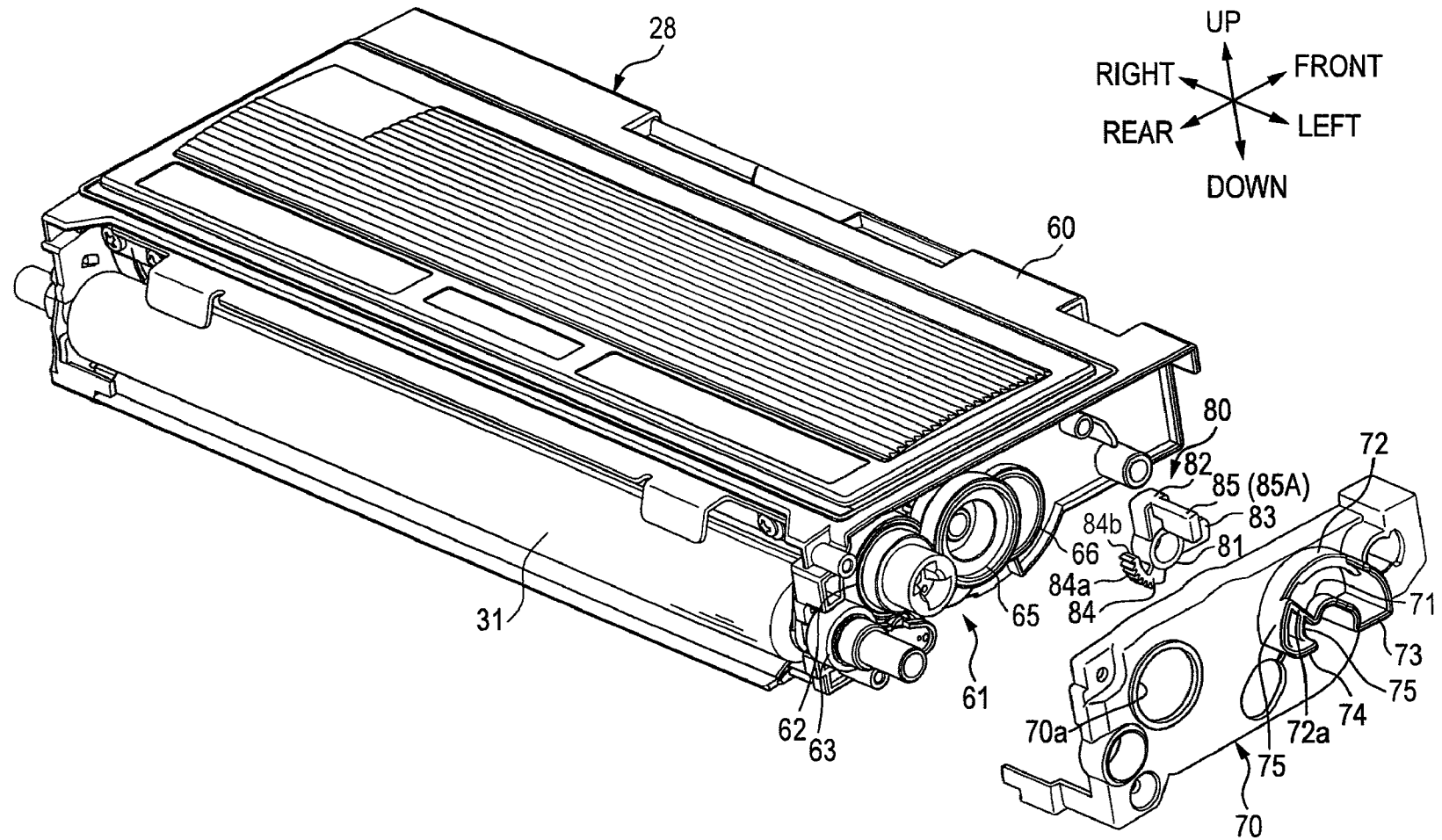
FIG. 2 is a perspective view showing a developer cartridge of a type where the maximum number of sheets to be printed is 3000.

As shown in FIG. 2, the developer cartridge 28 is formed not only with the developing roller 31 and the like but also with a cartridge body 60 and a cover body 70 detachably mounted to a left side surface of the cartridge body 60. Between the cartridge body 60 and the cover body 70, provided is a gear mechanism 61 for transmitting a driving force to the developing roller 31 and a rotational body 80 capable of being irreversibly rotatable in one direction.

Figure 3:
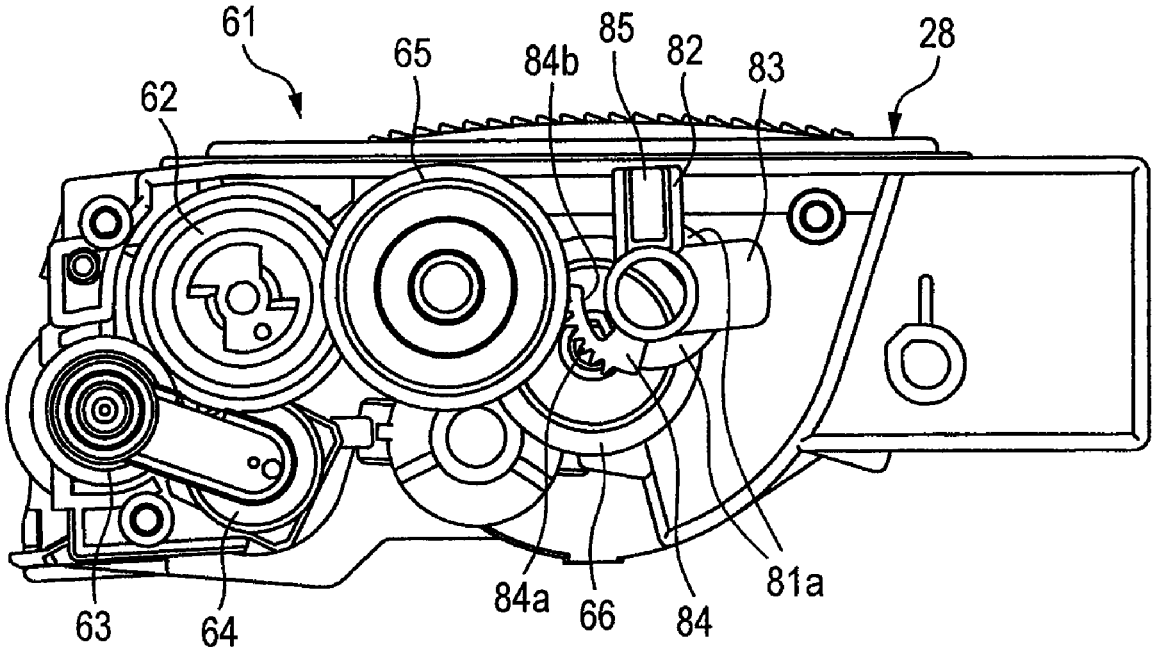
FIG. 3 is a side view of the developer cartridge of FIG. 2.

The gear mechanism 61 is, as shown in FIG. 3, formed with an input gear 62 transmitted with a driving force from a driving device 90 (see FIG. 5) provided on the main casing 2 side, a developing roller driving gear 63 and a supply roller driving gear 64 directly meshed with the input gear 62, and an agitator driving gear 66 meshed with the input gear 62 via an intermediate gear 65. Here, the developing roller driving gear 63, the supply roller driving gear 64, and the agitator driving gear 66 are gears to drive the developing roller 31, the supply roller 33, and the agitator 34*a* shown in FIG. 1, respectively, and are integrally provided at the end portions of respective axes of the developing roller 31, the supply roller 33, and the agitator 34*a*.

As shown in FIG. 2, the rotational body 80 includes a circular cylindrical shaft portion 81 as a rotational axis, and a first arm portion 82, a second arm portion 83 and a gear portion 84 which extend radially outside from the shaft portion 81. At a front end of the first arm portion 82 (a position deviated from the rotational axis of the rotational body 80), formed is an extended portion 85 extending along the rotational axis of the rotational body 80 and protruding from the surface of the cover body 70. Here, for the extended portion 85, the amount of extension is set according to the type of the developer cartridge 28. In the present embodiment, the extended portion 85 with a predetermined length shown in FIG. 2 is set as "a first extended portion 85A" corresponding to a type where the maximum number of sheets to be printed is 3000. In addition, as shown in FIG. 4, the extended portion 85 that is formed longer by a predetermined amount than the first extended portion 85A is set as "a second extended portion 85B" corresponding to a type where the maximum number of sheets to be printed is 6000.

As shown in FIG. 2, the gear portion 84 is formed in an almost fan shape gradually expanded radially toward the outside from the shaft portion 81, and is formed at its arc-shaped outer circumferential surface (a part of the entire circumference of the rotational body 80) with a gear tooth portion 84*a* that meshes with the intermediate gear 65 provided as a transmission gear. In other words, the gear tooth portion 84*a* is formed in the range of a part of a pitch circle that rotationally contacts with the intermediate gear 65. In addition, at a base-end side of the gear portion 84, formed is a notch 84*b* along the circumferential direction, and this makes the gear tooth portion 84*a* flexurally deformable. In addition, the first arm portion 82 and the gear portion 84 are connected with the second arm portion 83 formed wide via a rib 81*a* (see FIG. 3) formed at the periphery of a right-side end portion of the shaft portion 81. Thereby, rigidity of the first arm portion 82 and the gear portion 84 is secured.

In the cover body 70, mainly formed is an arc-shaped long groove 71 through which the extended portion 85 of the rotational body 80 is inserted, a groove peripheral wall 72 protruding from the periphery of the long groove 71 toward the left side (outside), and an opening portion 70*a* that exposes the input gear 62 outward. At a most front part of the groove peripheral wall 72, formed is an extending rib 73 having almost the same height in the left and right direction as that of the extended portion 85 so as to enclose the extended portion 85 from three directions of the rear, front, and down sides. Thereby, when the extended portion 85 is located at a front end of the long groove 71, the extending rib 73 prevents an external force from acting on the extended portion 85 from the three directions of the rear, front, and down sides. In addition, at a position away by a predetermined distance in the circumferential direction from a rearmost wall 72*a* of the groove peripheral wall 72, formed is a cover portion 74 having almost the same height as that of the extended portion 85 with a predetermined length from the front to the rear. Thereby, when the extended portion 85 is located at a rear end of the long groove 71, the cover portion 74 prevents an external force from acting on the extended portion 85 from an obliquely lower rear side.

Figure 4:
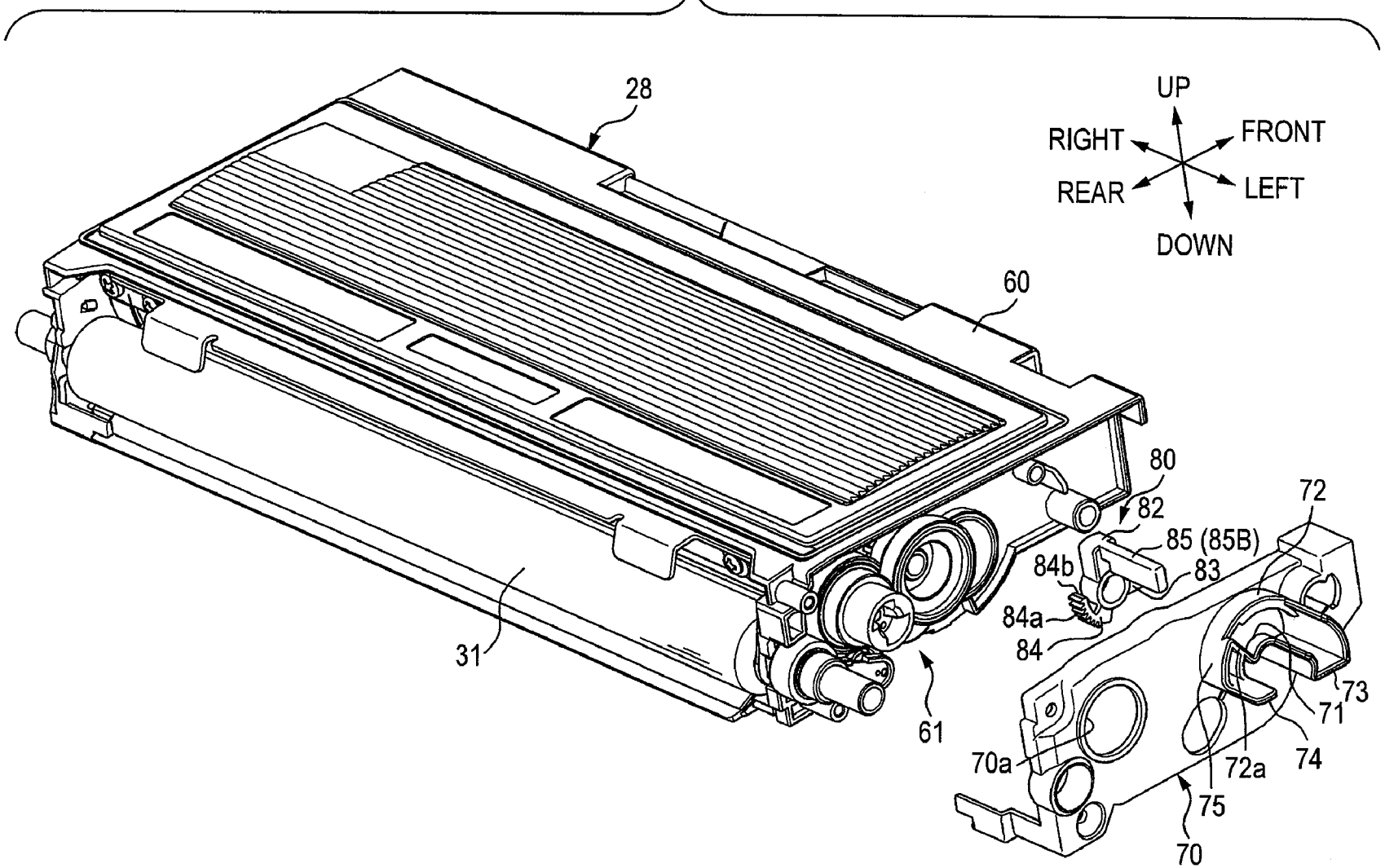
FIG. 4 is a perspective view showing a developer cartridge of a type where the maximum number of sheets to be printed is 6000.

Also, the extending rib 73 and cover portion 74 are appropriately set at a height according to the amount of extension of the extended portion 85 (see FIG. 4). In addition, the groove peripheral wall 72 and the cover portion 74 are connected by a pair of connection ribs 75, whereby rigidity of the cover portion 74 is secured.

In addition, the groove peripheral wall 72 other than the extending rib 73 and cover portion 74 is formed so as to be lower than the front end of the extended portion 85. Thereby, when the developer cartridge 28 is attached to the main casing 2 while the extended portion 85 is arranged at the rear end (initial position) of the long groove 71, the extended portion 85 contacts at that attaching position with a part of the main casing 2 in the front and rear direction. Here, "a part of the main casing 2" also includes elements of a device mounted on the main casing 2, and denotes, in the present embodiment, a first swing member 93 or a second swing member 95 of a new-product/type detecting device 91 to be described later (see FIG. 5).

<Detailed Structure of Inside of Main Casing>

Figure 5:
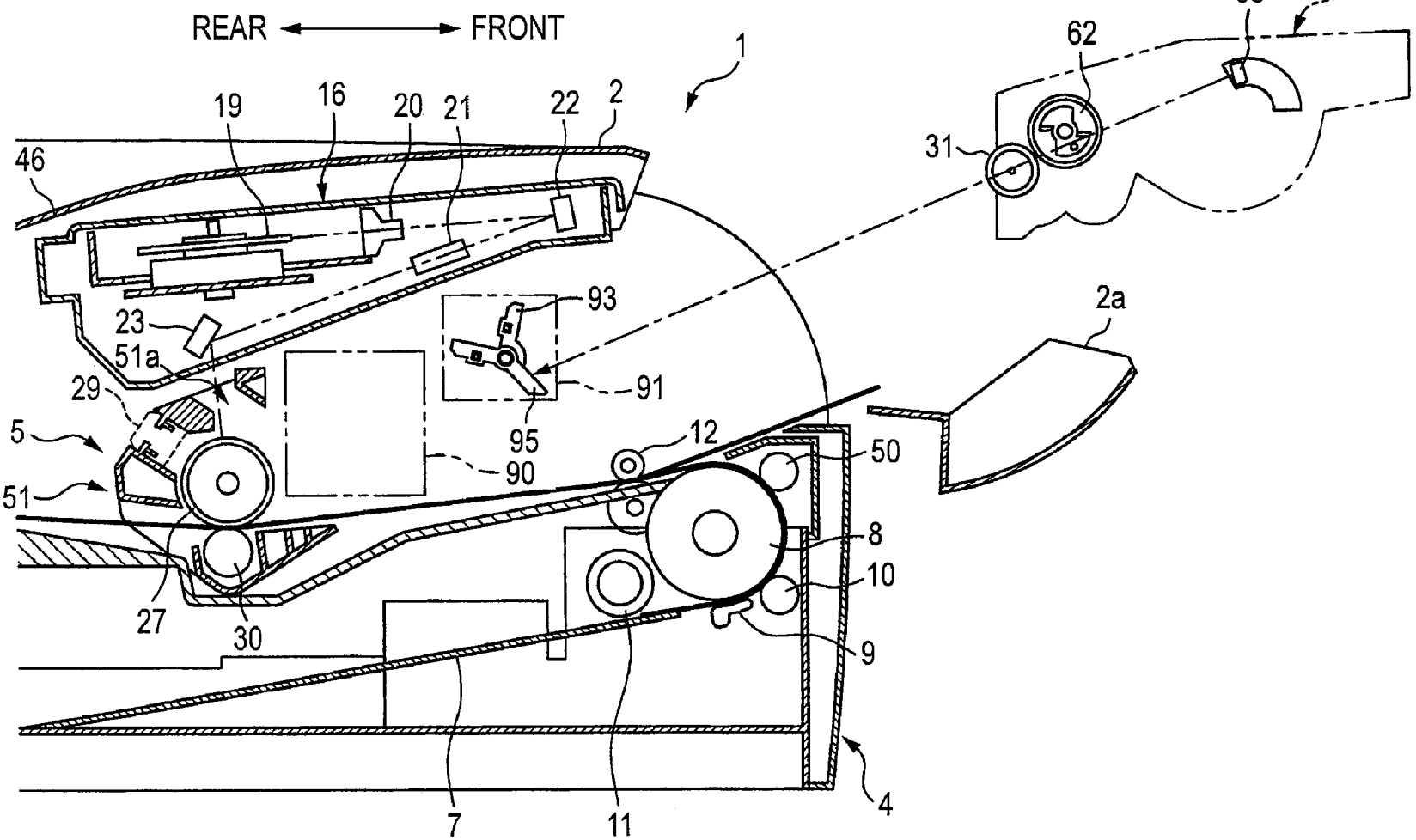
FIG. 5 is a cross-sectional view showing a state where the developer cartridge has been removed from a main casing.

As shown in FIG. 5, at a part where the developer cartridge 28 is attached in the main casing 2, provided is the driving device 90 that transmits a driving force to the input gear 62 of the developer cartridge 28 and the new-product/type detecting device 91 that detects whether the developer cartridge 28 is a new product and type of the developer cartridge 28.

The driving device 90 includes a plurality of gears and drive motor (not shown). As a result of a gear on the driving device 90 side meshing with the input gear 62 when the developer cartridge 28 is attached to the inside of the main casing 2, a driving force from the drive motor is transmitted to the input gear 62 via the respective gears. In the driving device 90, the gear to mesh with the input gear 62 is structured so as to advance and retract with respect to the developer cartridge 28 in conjunction with opening and closing of the front cover 2*a*, for example. In this case, the gear to mesh with the input gear 62, when the front cover 2*a* is closed, advances toward the developer cartridge 28 and meshes with the input gear 62, and when the front cover 2*a* is opened, retracts from the developer cartridge 28, and the meshing with the input gear 62 is released.

Figure 6A:
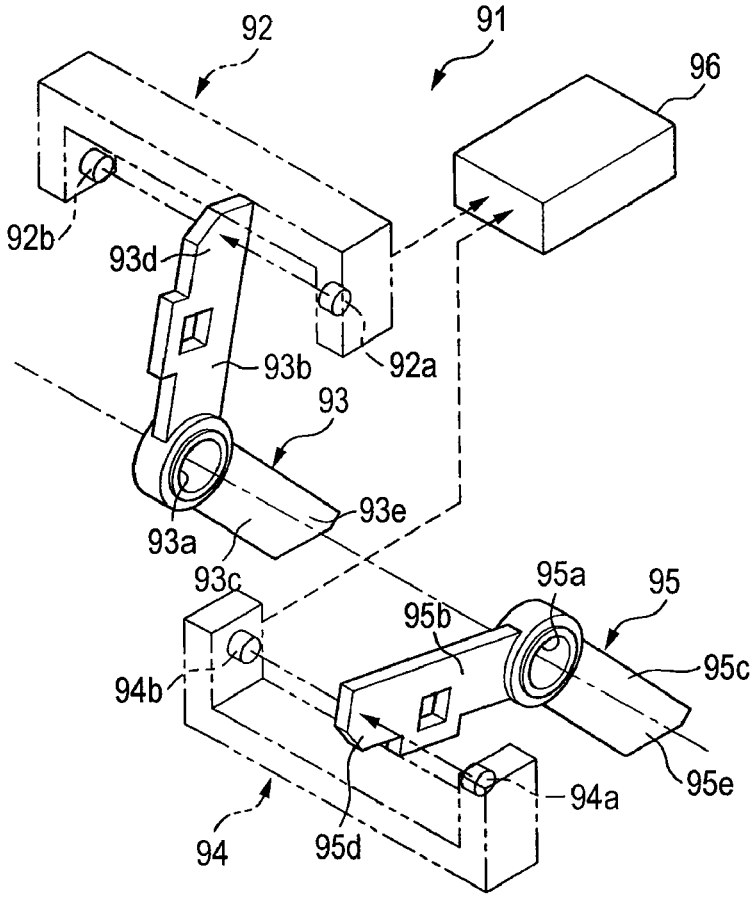

The new-product/type detecting device 91 is, as shown in FIG. 6A, formed mainly with a first optical sensor 92, a first swing member 93, a second optical sensor 94, and a second swing member 95 provided as a detecting unit and a controller 96 provided as a determining unit.

The first optical sensor 92 includes a first light emitting unit 92*a* that emits light and a first light receiving unit 92*b* that receives light emitted from the first light emitting unit 92*a*. The first optical sensor 92 outputs a predetermined signal to the controller 96 when having received light from the first light emitting unit 92*a* by the first light receiving unit 92*b*.

Figure 6B:
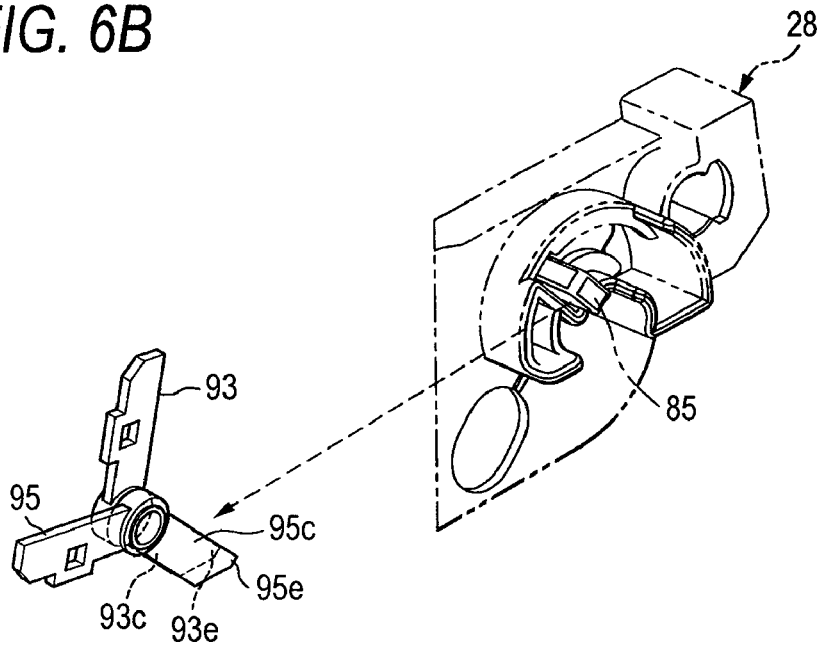

The first swing member 93 includes a cylindrical portion 93*a* rotatably attached to a shaft portion knot shown) provided on the main casing 2 and a light blocking arm 93*b* and a contacting arm 93*c* extending radially outside from the cylindrical portion 93*a*, and is formed so as to be swingable around the cylindrical portion 93*a*. The first swing member 93 is always urged to a neutral position by a spring (not shown). At this neutral position, a front end portion (one portion away from the swinging center) 93*d* (first portion) of the light blocking arm 93*b* is arranged between the first light emitting unit 92*a* and the first light receiving unit 92*b* (first state). Moreover, at the neutral position, a front end portion (the other portion away from the swinging center) 93*e* (second portion) of the contacting arm 93*c* is arranged, as shown in FIG. 6B, at a position on the base-end side of the extended portion 85 of the developer cartridge 28 to be attached to the main casing 2 and where contact with the extended portion 85 is possible (an opposing position).

The second optical sensor 94 includes a second light emitting unit 94*a* that emits light and a second light receiving unit 94*b* that receives light emitted from the second light emitting unit 94*a*. The second optical sensor 94 outputs a predetermined signal to the controller 96 when having received light from the second light emitting unit 94*a* by the second light receiving unit 94*b*.

The second swing member 95 includes a cylindrical portion 95*a* rotatably attached to a shaft portion (not shown) provided on the main casing 2 and a light blocking arm 95*b* and a contacting arm 95*c* extending radially outside from the cylindrical portion 95*a*, and is formed so as to be swingable around the cylindrical portion 95*a*. The second swing member 95 is always urged to a neutral position by a spring (not shown). At this neutral position, a front end portion (one portion away from the swinging center) 95*d* (third portion) of the light blocking arm 95*b* is arranged between the second light emitting unit 94*a* and the second light receiving unit 94*b*. Moreover, at the neutral position, a front end portion (the other portion away from the swinging center) 95*e* (fourth portion) of the contacting arm 95*c* is arranged, as shown in FIG. 6B, a position on the front-end side of the extended portion 85 of the developer cartridge 28 to be attached to the main casing 2 and where contact with the extended portion 85 (more specifically, only the second extended portion 85B formed higher) is possible. That is, the front end portion 93*e* of the contacting arm 93*c* of the first swing member 93 and the front end portion 95*e* of the contacting arm 95*c* of the second swing member 95 are provided side by side in the extending direction of the extended portion 85. Also, the contacting arm 95*c* of the second swing member 95 is located at a position separated from the first extended portion 85A formed lower than the second extended portion 85B in the left and right direction and is therefore unable to contact with the first extended portion 85A.

Moreover, in the present embodiment, the arranging position of the light blocking arm 93*b* with respect to the contacting arm 93*c* and the arranging position of the light blocking arm 95*b* with respect to the contacting arm 95*c* differ from each other around the swinging center. In a configuration for sensing the amount of extension of the extended portion 85, it is necessary to arrange a plurality of sensing devices in its extending direction, however, in the present embodiment, by forming the first swing member 93 and the second swing member 95 as mentioned above, the first optical sensor 92 and the second optical sensor 94 are arranged in a manner displaced around the swinging center of the first swing member 93 and the second swing member 95, and the apparatus is thus reduced in size.

The controller 96 has a function to determine whether the developer cartridge 28 is a new product and determine a type of the developer cartridge 28 based on signals from the first optical sensor 92 and the second optical sensor 94. Concretely, the controller 96 executes a known idle rotation operation based on a closing signal from a sensor that senses a closing operation of the front cover 2*a* or a signal generated when the laser printer 1 is powered on. The controller 96 determines, when not having received a signal from either of the optical sensors 92 and 94 in a time between the start and end of the idle rotation operation, that the developer cartridge 28 is an old product. In addition, when the controller 96 has received only a signal from the first optical sensor 92 within the time, it is determined that the developer cartridge 28 is a new product and is of a type where the maximum sheets to be printed are 3000. Furthermore, when the controller 96 has received signals respectively from both optical sensors 92 and 94 within the time, it is determined that the developer cartridge 28 is a new product and is of a type where the maximum sheets to be printed are 6000. However, since the process (control method) for a new-product determination and a type determination is known (see Japanese Published Unexamined Patent Application No. 2006-267994, for example), detailed description thereof will be omitted.

Next, description will be given of operations of the rotational body 80, the first swing member 93, and the second swing member 95 when two types of developer cartridges 28 are attached to the main casing 2 with reference to FIGS. 7A to 8D. New developer cartridges are shown in both of FIGS. 7A to 7D and 8A to 8D, respectively.

<Type where the Maximum Sheets to be Printed are 3000>

First, description will be given of operations when the developer cartridge 28 of a type where the maximum sheets to be printed are 3000 is attached to the main casing 2.

Figure 7A:
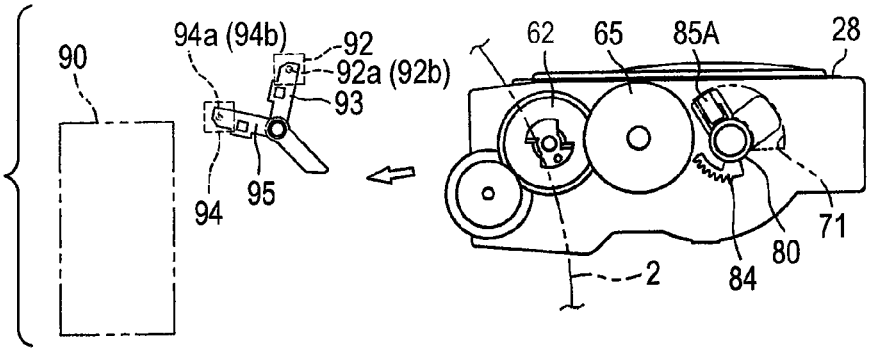

As shown in FIG. 7A, before the developer cartridge 28 is attached to the main casing 2, the first extended portion 85A is located at a rearmost end of the long groove 71 (a first rotation position), and at this position, the gear portion 84 is arranged at a position separated from the intermediate gear 65.

Figure 7B:
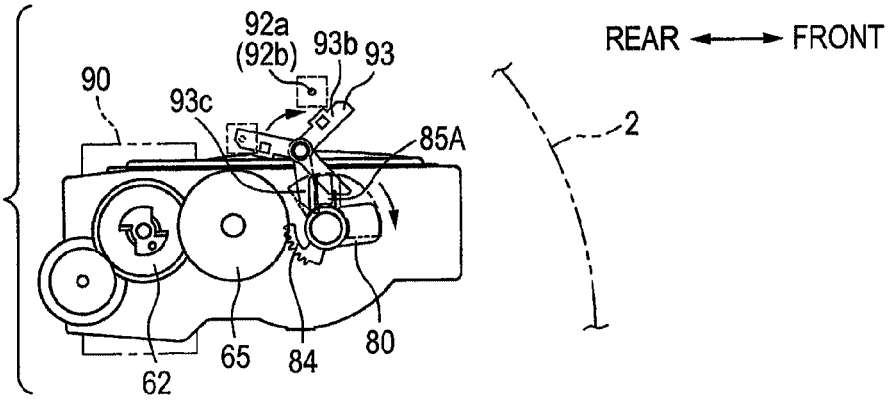

Then, as shown in FIG. 7B, when the developer cartridge 28 is inserted up to a predetermined mounting position in the main casing 2, the first extended portion 85A having a lower extending amount contacts only with the contacting arm 93*c* of the first swing member 93. At this time, the first extended portion 85A contacts with the contacting arm 93*c* of the first swing member 93 always urged to the neutral position by a spring and its movement is restrained, and the first extended portion 85A thus relatively moves to the front side (fourth rotation position) by a predetermined amount with respect to the developer cartridge 28 that is moving to the mounting position. Thereby, the rotational body 80 is rotated clockwise by a predetermined amount, and the gear portion 84 of the rotational body 80 meshes with the intermediate gear 65.

Then, when the gear portion 84 and the intermediate gear 65 mesh with each other, the intermediate gear 65 restrains the rotational body 80 from rotation, the first extended portion 85A again moves with the developer cartridge 28 to press the contacting arm 93*c* to the rear side against an urging force of the spring. Thereby, the light blocking arm 93*b* of the first swing member 93 is swung to the front side (a second state), light from the first light emitting unit 92*a* is received by the first light receiving unit 92*b*, and the first optical sensor 92 is turned on to output a predetermined ON signal to the controller 96.

Thereafter, the controller 96 executes an idle rotation operation based on, for example, a signal indicating a closing operation of the front cover 2*a*. Also, at the start of this idle rotation operation, the controller 96 has been continuously receiving the ON signal.

Figure 7C:
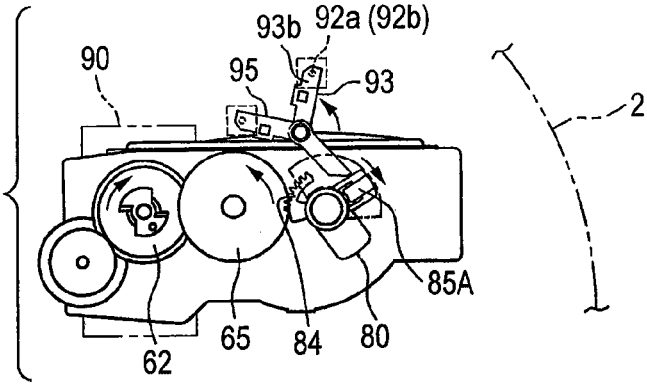

Then, when the controller 96 starts the idle rotation operation, as shown in FIG. 7C, a driving force of the driving device 90 is transmitted to the gear portion 84 via the input gear 62 and the intermediate gear 65, and the rotational body 80 is rotated clockwise. That is, the rotational body 80 begins to rotate substantially at a time of beginning of a drive of the laser printer 1. Then, when the rotational body 80 rotates as such, the first extended portion 85A moves to the front side (second rotation position), and the first swing member 93 returns to the neutral position (first state) by the urging force of the spring. Thereby, the light blocking arm 93*b* of the first swing member 93 returns to the original position to block light from the first light emitting unit 92*a*, and the first optical sensor 92 is turned off to stop transmission of the ON signal to the controller 96.

Figure 7D:
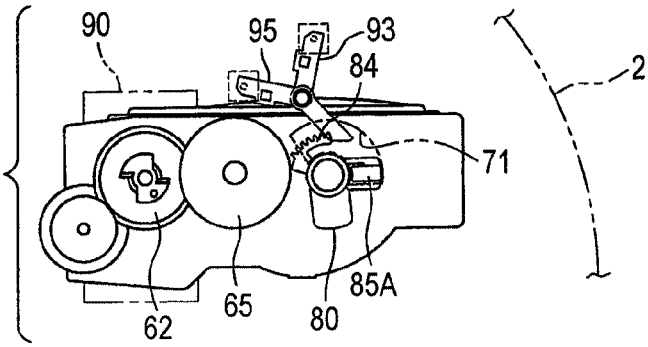

Thereafter, when the rotational body 80 further rotates and, as shown in FIG. 7D, the first extended portion 85A is located at a front end of the long groove 71 (third rotation position), the gear portion 84 separates from the intermediate gear 65 and the rotational body 80 is restrained from rotation. The gear portion 84 and the intermediate gear 65 may be separated from each other at any position between the fourth rotation position and the third rotation position. That is, the rotational body 80 rotates irreversibly around equal to or less than 360 degrees in one direction. Then, after ending the idle rotation operation, the controller 96 determines that the developer cartridge 28 is a new product and is of a type where the maximum sheets to be printed are 3000 based on the single signal (ON signal from the first optical sensor 92) received during the idle rotation operation.

<Type where the Maximum Sheets to be Printed are 6000>

Next, description will be given of operations when the developer cartridge 28 of a type where the maximum sheets to be printed are 6000 is attached to the main casing 2. Also, in the following description, description of the same structures and operations (such as the initial position and rotating operation of the rotational body 80) as those of the type of 3000 images mentioned above will be appropriately omitted.

Figure 8A:
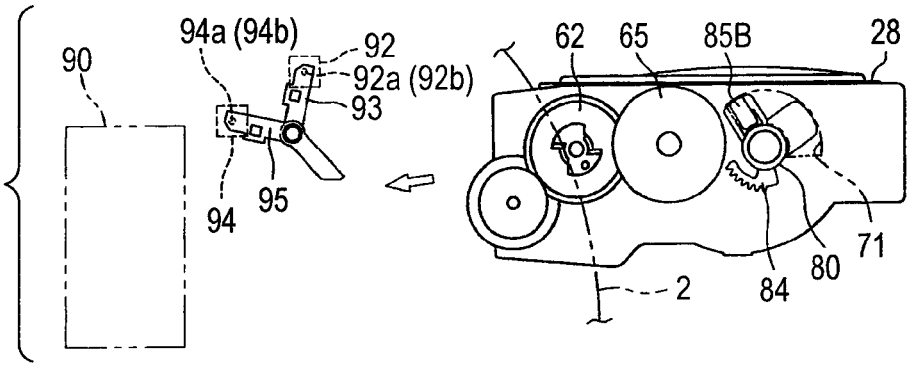
Figure 8B:
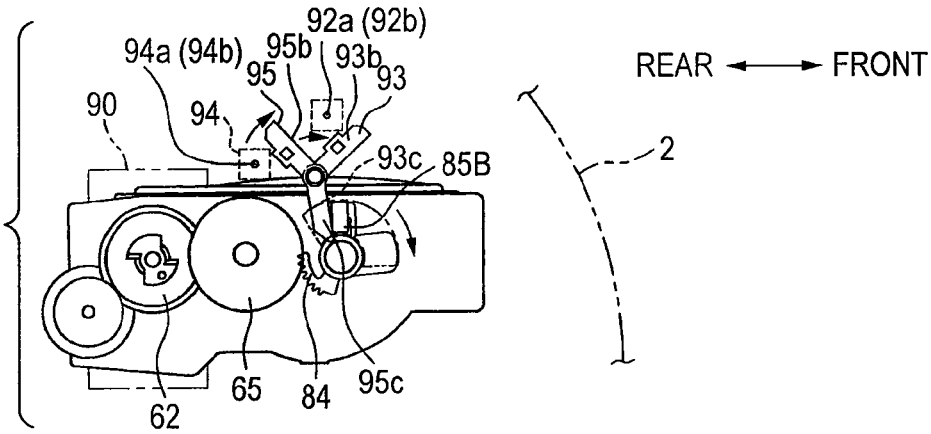

As shown in FIG. 8A to FIG. 8B, when the developer cartridge 28 is inserted up to a predetermined mounting position in the main casing 2, the second extended portion 85B having a higher extending amount (at the first rotation position) contacts with both the contacting arm 93*c* of the first swing member 93 and the contacting arm 95*c* of the second swing member 95. Then, when the developer cartridge 28 is inserted further (and the second extended portion 85B reaches the fourth rotation position), by the second extended portion 85B of the rotational body 80 locked by meshing between the gear portion 84 and the intermediate gear 65, the contacting arm 93*c* of the first swing member 93 and the contacting arm 95*c* of the second swing member 95 are both pressed to the rear side (second state). Thereby, the light blocking arm 93*b* of the first swing member 93 is swung to the front side, light from the first light emitting unit 92*a* is received by the first light receiving unit 92*b* and the light blocking arm 95*b* of the second swing member 95 is swung to the front side, so that light from the second light emitting unit 94*a* is received by the second light receiving unit 94*b*. Therefore, the first optical sensor 92 is turned on to output a predetermined ON signal to the controller 96, and the second optical sensor 94 is also turned on to output a predetermined ON signal to the controller 96.

Figure 8C:
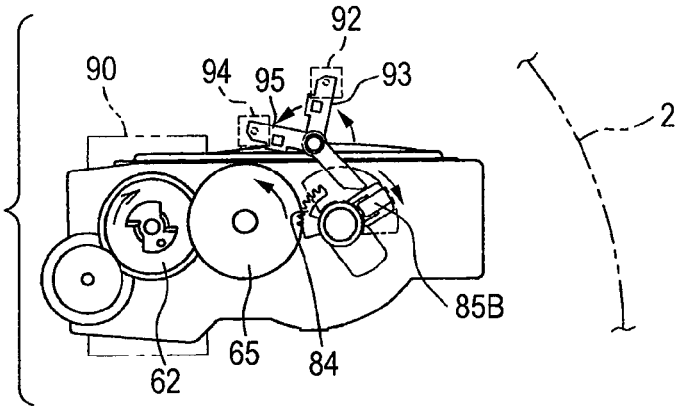
Figure 8D:
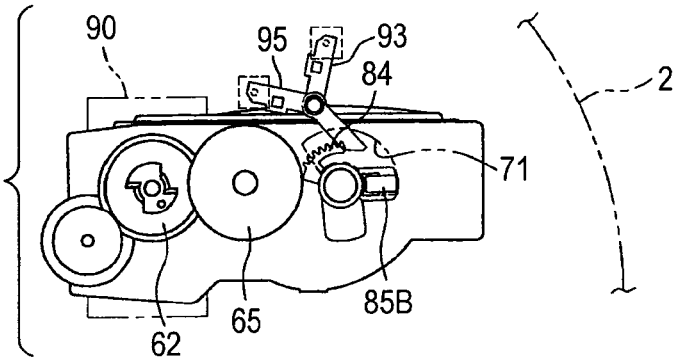

Thereafter, as shown in FIG. 8C to FIG. 8D, the same operation (an idle rotation operation or the like) as that of the type of 3000 images is carried out. Then, after ending the idle rotation operation, the controller 96 determines that the developer cartridge 28 is a new product and is of a type where the maximum sheets to be printed are 6000 based on the two signals (ON signals from the first optical sensor 92 and the second optical sensor 94) received during the idle rotation operation.

According to the above, the following effects can be obtained in the present embodiment.

Since the controller 96 can determine the presence of a movement of the extended portion 85 and a difference in the amount of extension according to the number of signals received from the first optical sensor 92 and the second optical sensor 94, new-product detection and type detection can be satisfactorily carried out. Moreover, since this structure allows carrying out type detection by only changing the extended portion 85 by the amount of extension, in comparison with the structure to contact two contact projections arranged in the rotating direction with the actuator as in the conventional art, the amount of rotation of the rotation can be reduced, so that the size of the developer cartridge 28 can be reduced.

The gear portion 84 of the rotational body 80 meshes with the intermediate gear 65 as a result of the extended portion 85 being moved by the contacting arm 93*c* to the front side relatively with respect to the developer cartridge 28 when the developer cartridge 28 is attached to the main casing 2, so that in a state before attachment, the gear portion 84 and the intermediate gear 65 are maintained in an unmeshed state unless a force is applied to the extended portion 85. Accordingly, at the time of testing before factory shipment, even when the respective gears 62 to 66 of the developer cartridge 28 are rotated, since the rotational body 80 never rotates with the respective gears 62 to 66, the extended portion 85 can be kept maintained at a regular position until the developer cartridge 28 is mounted on the main casing 2.

As a result of the cover portion 74 having almost the same height as that of the extended portion 85 being formed at the obliquely lower rear side of the rear end of the long groove 71, when the extended portion 85 is located at the rear end of the long groove 71, the cover portion 74 prevents an external force from acting on the extended portion 85 from the obliquely lower rear side. Therefore, for example, at the time of testing before factory shipment, the extended portion 85 is inhibited from being pressed by an operator or the like, and the extended portion 85 can be reliably kept maintained at the regular position.

As a result of the extending rib 73 having almost the same height as that of the extended portion 85 being formed at the front end of the long groove 71 so as to enclose the extended portion 85 from the three directions of the rear, front, and down sides, when the extended portion 85 is located at the front end of the long groove 71, the extending rib 73 prevents an external force from acting on the extended portion 85 from the three directions of the rear, front, and down sides. Therefore, when, for example, the developer cartridge 28 in the middle of usage is removed from the main casing 2 (for example, the time of a paper jam or the like), even if a user intends to touch the extended portion 85, since the extending rib 73 has made the extended portion 85 difficult to touch, this can inhibit erroneous detection of a new product determination caused by a user's erroneous operation.

Since the gear tooth portion 84*a* has been formed so as to be flexurally deformable radially inside, even if the rotational body 80 vigorously rotates as a result of the developer cartridge 28 being vigorously attached to the main casing 2 and the gear tooth portion 84*a* thereof vigorously collides with the intermediate gear 65, the shock can be buffered. In addition, even when the front ends of the respective teeth of the gear tooth portion 84*a* and the intermediate gear 65 hit against each other, since the front end positions of the teeth are displaced due to flexure of the gear tooth portion 84*a*, the gear tooth portion 84*a* and the intermediate gear 65 can be satisfactorily meshed with each other.

Here, the present invention can be used in various embodiments as exemplified in the following without being limited to the above embodiment.

In the above embodiment, the amount of extension of the extended portion 85 has been detected by arranging the two swing members 93 and 95 at the base-end side and the front-end side of the extended portion 85, respectively, however, the present invention is not limited hereto. The amount of extension may be detected by, for example, providing a mirror at the front end of the extended portion, providing an optical sensor opposed to the mirror in the extending direction of the extended portion and detecting the distance between the front end of the extended portion and the optical sensor. Also, as such a distance sensor, without limitation to an optical sensor, an ultrasonic sensor or the like may be used.

Moreover, the amount of extension can also be detected by, for example, providing a leaf spring so as to contact with the extended portion that moves with a rotation of the rotational body and providing a strain gauge on this leaf spring. That is, by arranging a leaf spring so that, in the case of a short extension, the amount of flexure of the leaf spring is reduced, and in the case of a long extension, the amount of flexure of the leaf spring is increased, the amount of extension can be detected.

In the above embodiment, each swing member 93, 95 has been made so as to be swingable by supporting almost a central portion of each swing member 93, 95 about an axis, however, the present invention is not limited hereto, and one end of the swing member may be supported about an axis, for example. Also, in this case, it is sufficient, for example, to arrange the other end of the swing member at a position where contact with the extended portion is possible and arrange a part between one end and the other end of the swing member between the light emitting unit and the light receiving unit of the optical sensor.

In the above embodiment, the gear portion 84 and the intermediate gear 65 have been meshed with each other by making the extended portion 85 contact with the first swing member 93 and the like when the developer cartridge 28 is attached to the main casing 2, however, the present invention is not limited hereto. That is, any object with which the extended portion 85 is made to contact is acceptable as long as it is a part of the main casing 2 (an element on the main casing 2 side). However, since setting the object with which the extended portion 85 is made to contact as the first swing member 93 or the like as in the present embodiment makes it possible to suppress the number of elements, such a manner as in the above embodiment is desirable.

In the above embodiment, the cover portion 74 has been provided at the obliquely lower rear side of the rear end of the long groove 71, however, the present invention is not limited hereto, the cover portion 74 may be provided at any position as long as it is a direction different from the direction in which the contacting arms 93*c* and 95*c* of the respective swing members 93 and 95 contact with the extended portion 85.

In the above embodiment, the present invention has been applied to the laser printer 1, however, the present invention is not limited hereto, and the present invention may be applied to other image forming apparatuses such as, for example, copiers and multi function devices.

What is claimed is:

1. An image forming apparatus comprising:

a main unit; and a developer cartridge detachably attached to the main unit, wherein the developer cartridge comprises:

a rotational body having a rotational axis and rotatable in a rotation direction; and an extended portion formed on the rotational body to extend along the rotational axis, the extended portion rotatable around the rotational axis, and wherein the main unit comprises:

a driving unit configured to rotate the rotational body in the rotation direction;

a detecting unit configured to detect a movement of the extended portion and an extending amount of the extended portion; and a determining unit configured to:

determine whether the developer cartridge is a new product according to a presence of a movement of the extended portion detected by the detecting unit; and determine a type of the developer cartridge based on the extending amount of the extended portion detected by the detecting unit.

2. The image forming apparatus according to claim 1, wherein the extended portion is arranged at a position to be opposed to the detecting unit when the developer cartridge is attached to the main unit, wherein the detecting unit comprises:

a first sensor;

a first swing member swingable around a first swinging center with respect to the main unit, the first swing member having a first portion and a second portion which are positioned away from the first swinging center;

a second sensor; and a second swing member swingable around a second swinging center with respect to the main unit, the second swing member having a third portion and a fourth portion which are positioned away from the second swinging center, wherein the first swing member is swingable between a first swing state where the first portion is positioned in a first region and a second swing state where the first portion is positioned in a second region other than the first region, the first sensor configured to detect the first swing member in the first region, wherein the second swing member is swingable between a third swing state where the third portion is positioned in a third region and a fourth swing state where the third portion is positioned in a fourth region other than the third region, the second sensor configured to detect the second swing member in the third region, wherein the second portion of the first swing member and the fourth portion of the second swing member are arranged in a direction of extending the extended portion, and wherein each of the second portion and the fourth portion is contactable with the extended portion depending on the extending amount of the extended portion.

3. The image forming apparatus according to claim 1, further comprising a transmission gear configured to transmit a driving force from the driving unit to the rotational body, wherein the extended portion is arranged at a position that allows a part of the main unit to contact the extended portion at a time of attaching the developer cartridge to the main unit, and wherein the rotational body meshes with the transmission gear by a rotation of the rotational body in response to the extended portion contacting the part of the main unit.

4. The image forming apparatus according to claim 3, wherein the developer cartridge comprises a cover portion configured to prevent an external force from acting on the extended portion from a direction different than a direction in which the part of the main unit contacts the extended portion.

5. The image forming apparatus according to claim 1, wherein the detecting unit comprises a swing member swingable around a swinging center and contactable with the extended portion, and wherein the swing member swings from a first swing state to a second swing state when the extended portion contacts the swing member.

6. The image forming apparatus according to claim 5, wherein the swing member is urged in a direction to take the first swing state, thereby the swing member is kept in the first swing state when the extended portion is separated from the swing member.

7. The image forming apparatus according to claim 6, wherein the determining unit determines that the developer cartridge is a new product when the detecting unit detects that the swing member is in the second swing state.

8. The image forming apparatus according to claim 5, wherein the extended portion is rotatable in the rotation direction from a first rotation position to a third rotation position via a second rotation position, wherein the extended portion contacts the swing member when the extended portion is positioned upstream from the second rotation position in the rotation direction, wherein the extended portion is separated from the swing member when the extended portion is positioned between the second rotation position and the third rotation position.

9. The image forming apparatus according to claim 8, further comprising a transmission gear configured to transmit a driving force from the driving unit to the rotational body, wherein the rotational body comprises a rotational gear formed on a part of a circumference of the rotational body and configured to mesh with the transmission gear.

10. The image forming apparatus according to claim 9, wherein the rotational gear is unmeshed with the transmission gear when the extended portion is positioned at the first rotation position.

11. The image forming apparatus according to claim 10, wherein, during an attaching operation of the developer cartridge to the image forming apparatus, a part of the main unit contacts the extended portion and applies a force to the extended portion to move from the first rotation position to a fourth rotation position that is upstream from the second rotation position, wherein, when a rotation position of the extended portion is changed from the first rotation position to the fourth rotation position, the rotational gear is meshed with the transmission gear.

12. The image forming apparatus according to claim 11, wherein when the rotation position of the extended portion is changed to a position between the fourth rotation position and the third rotation position, a mesh of the rotational gear with the transmission gear is released.

13. The image forming apparatus according to claim 1, wherein the rotational body is irreversibly rotatable in the rotation direction.

14. The image forming apparatus according to claim 1, wherein the rotational body is rotatable around equal to or less than 360 degrees in the rotation direction.

15. The image forming apparatus according to claim 1, wherein the rotational body begins to rotate substantially at a time of beginning of a drive of the main unit.

* * * * *